US010795294B2

(12) United States Patent
Tanto

(10) Patent No.: US 10,795,294 B2
(45) Date of Patent: Oct. 6, 2020

(54) FIXING APPARATUS

(71) Applicant: CANON KABUSHIKI KAISHA, Tokyo (JP)

(72) Inventor: Tomoaki Tanto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/701,359

(22) Filed: Dec. 3, 2019

(65) Prior Publication Data

US 2020/0183310 A1 Jun. 11, 2020

(30) Foreign Application Priority Data

Dec. 6, 2018 (JP) ..... 2018-229381

(51) Int. Cl.
*G03G 15/20* (2006.01)

(52) U.S. Cl.
CPC ..... *G03G 15/2053* (2013.01); *G03G 15/2039* (2013.01); *G03G 2215/2003* (2013.01)

(58) Field of Classification Search
CPC ..... G03G 15/2017; G03G 15/2039; G03G 15/2053; G03G 2215/20; G03G 2215/2003
See application file for complete search history.

(56) References Cited

U.S. PATENT DOCUMENTS 9,037,057 B2 5/2015 Suzuki et al.
9,141,050 B2 9/2015 Kasuya et al.
9,632,465 B2 4/2017 Suzuki
9,811,038 B2 11/2017 Tanto
2002/0071700 A1* 6/2002 Nishitani ..... G03G 15/2039 399/328
2014/0233995 A1* 8/2014 Kasuya ..... G03G 15/2053 399/329
2016/0170338 A1* 6/2016 Tateishi ..... G03G 15/206 399/329
2016/0252856 A1* 9/2016 Suzuki ..... G03G 15/2053 399/329

FOREIGN PATENT DOCUMENTS

JP 2012-252061 A 12/2012
JP 2014-186308 A 10/2014
JP 2016-161624 A 9/2016

* cited by examiner

*Primary Examiner* — Thomas S Giampaolo, II
(74) *Attorney, Agent, or Firm* — Venable LLP

(57) ABSTRACT

A fixing apparatus includes an endless belt, a heating member configured to heat the belt, a detection unit configured to detect temperature of the heating member, a signal line connected to the detection unit, a holding member configured to hold the temperature detecting member, and an urging member configured to urge the temperature detecting member toward the heating member. The holding member includes a through hole for leading out the signal line and a contact portion being in contact with the signal line at a position located, in a width direction of the belt, between the through hole and the temperature detecting member and located, in an urging direction of the urging member, at a same position with a connecting portion between the signal line and the temperature detecting member or at a position closer to the heating member than the connecting portion.

6 Claims, 8 Drawing Sheets

Prior Art

FIXING APPARATUS

BACKGROUND OF THE INVENTION

Field of the Invention

The present invention relates to a fixing apparatus suitably used in an image forming apparatus utilizing an electrophotographic technology such as a printer, a copier, a facsimile and a multi-function printer.

Description of the Related Art

An image forming apparatus is provided with a fixing apparatus configured to fix a toner image on a recording member by applying heat and pressure to the recording member on which a non-fixed toner image has been formed. For instance, as disclosed in Japanese Patent Application Laid-open No. 2014-186308, a belt heating type fixing apparatus including a rotating endless fixing belt (called also as a fixing film), a heater in contact with an inner circumferential surface of the fixing belt and a roller in contact with the fixing belt from outside (called as a pressure roller) has been conventionally proposed. According to this fixing apparatus, a recording member is nipped and is conveyed through a fixing nip portion defined between the fixing belt, being pressed by the pressure roller, and the pressure roller in a condition of being pressed and heated to fix the toner image onto the recording member. In a case of such belt heating type fixing apparatus, the heater generates heat corresponding to power supplied thereto, and the fixing belt is heated by the heat of the heater transmitted to the fixing belt. Then, the fixing apparatus is provided with a contact type temperature sensor to detect the temperature of the heater in order to heat the toner image at proper temperature. For instance, in a case of a thermistor sensor using a thermistor for the detection unit, it is difficult to accurately detect the temperature if the thermistor is not appropriately in contact with the heater. Then, the contact type temperature sensor such as the thermistor sensor is movably held by a sensor holding member and is urged toward the heater by a spring or the like.

In the case of the belt heating type fixing apparatus described above, the fixing belt is arranged to be replaceable by a user because the fixing belt is liable to deteriorate as compared to other component parts. In order to improve replaceability of the fixing belt to be replaced by the user, the fixing belt is unitized together with the heater and the sensor holding member to be able to attach/detach to/from an apparatus body of the image forming apparatus as the whole unit. Then, because temperature control of the heater based on a detection result of the temperature sensor is made between a control portion and a power source provided in the apparatus body of the image forming apparatus, signal lines connected to the heater, the temperature sensor and others are wired to the belt unit. From an aspect of being able to readily wire the signal lines in general, a plurality of signal lines is wired as a bundled wire, and a connector is provided at an edge of the bundle wire. The user connects or disconnects the connector on the apparatus body side with/from the connector on the belt unit side to attach/detach the belt unit.

By the way, there may be a case where the user strongly pulls the signal line to connect the connector on the apparatus body side with the connector on the belt unit side in attaching the belt unit. There may be also a case where the user strongly pulls the signal line to wire the signal line in replacing the fixing belt. There may be also a case where a manufacturer strongly pulls the signal line of the temperature sensor in assembling the belt unit. In a case where the user or the manufacturer strongly pulls the signal line as described above in the prior art apparatus, the temperature sensor to which the signal line is connected is liable to be inclined with respect to the heater.

In the case of the contact type temperature sensor, if the temperature sensor is inclined with respect to the heater, the detection unit does not properly come into contact with the heater and thus it is difficult to detect temperature accurately. Then, it has been demanded, since the past, to provide a fixing apparatus which can keep a condition in which the detection unit is properly in contact with the heater without inclining the temperature sensor even if the signal line connected to the temperature sensor is strongly pulled by the user.

SUMMARY OF THE INVENTION

According to one aspect of the present invention, a fixing apparatus includes an endless belt, a heating member configured to heat the belt, a temperature detecting member including a detection unit being in contact with the heating member and configured to detect temperature of the heating member, and a signal line connected to the detection unit, a holding member provided on a side opposite to the heating member across the temperature detecting member and configured to hold the temperature detecting member, and an urging member provided between the holding member and the temperature detecting member and configured to urge the temperature detecting member toward the heating member. The holding member includes a through hole for leading out the signal line and a contact portion being in contact with the signal line at a position located, in a width direction of the belt, between the through hole and the temperature detecting member and located, in an urging direction of the urging member, at a same position with a connecting portion between the signal line and the temperature detecting member or at a position closer to the heating member than the connecting portion.

Further features of the present invention will become apparent from the following description of exemplary embodiments with reference to the attached drawings.

DESCRIPTION OF THE EMBODIMENTS

First Embodiment

Image Forming Apparatus

Figure 1:
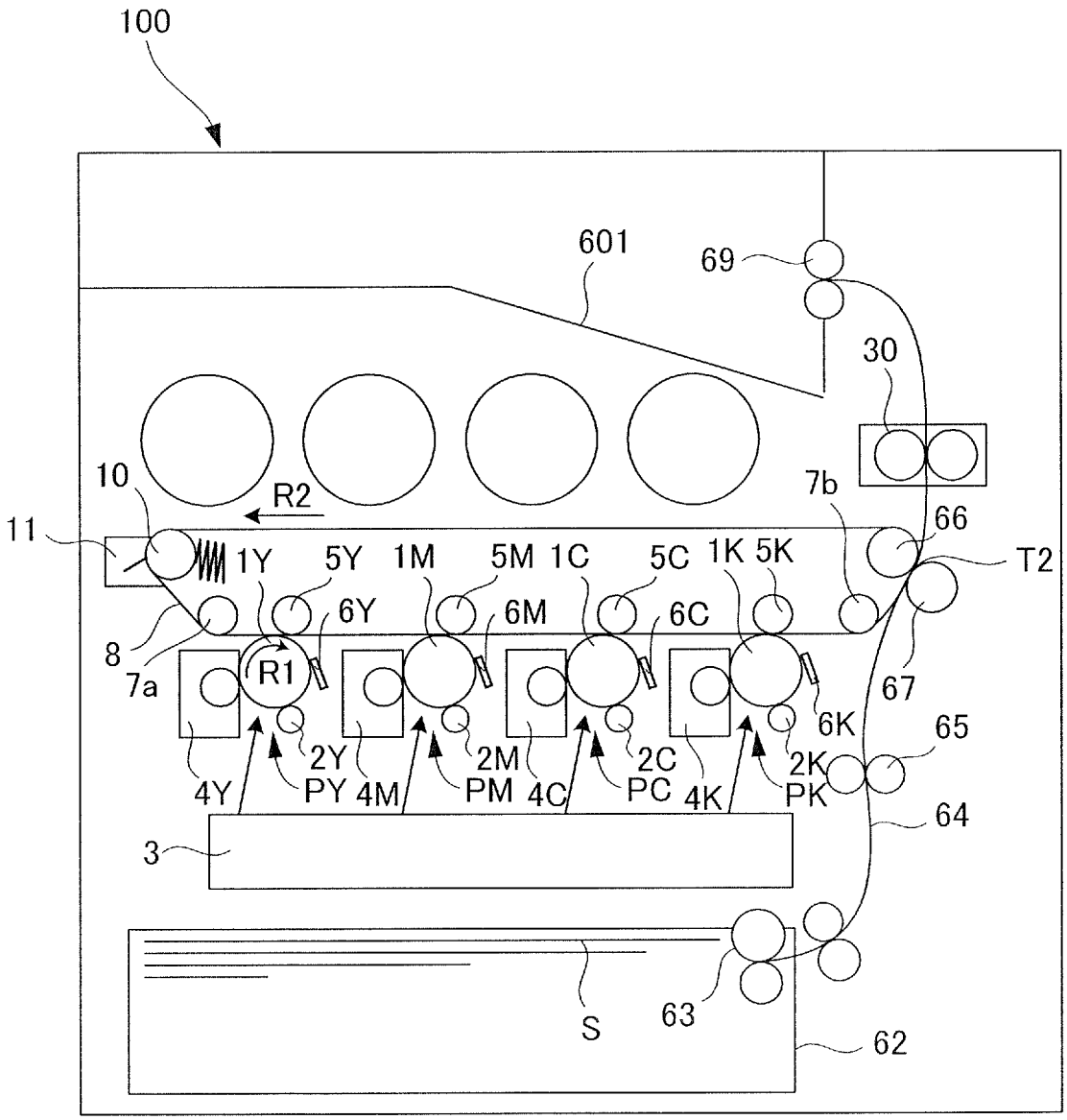
FIG. 1 is a schematic diagram illustrating a configuration of an image forming apparatus for which a fixing apparatus of a present embodiment is suitably used.

A fixing apparatus of the present embodiment will be described below. Firstly, an image forming apparatus for which the fixing apparatus of the present embodiment is suitably used will be described with reference to FIG. 1. The image forming apparatus 100 illustrated in FIG. 1 is an intermediate transfer tandem type color image forming apparatus in which four color, i.e., yellow, cyan, magenta and black, image forming units PY, PM, PC and PK are disposed so as to face an intermediate transfer belt 8.

A process for conveying a recording member of the image forming apparatus 100 will be described. The recording member S is stored in a manner of being loaded within a cassette 62 and is fed by a sheet feed roller 63 to a sheet conveyance path 64 one by one in synchronism with an image forming timing. A recording member S loaded in a manual feed tray not illustrated may be also fed one by one to the sheet conveyance path 64. When the recording member S is conveyed to a registration roller 65 disposed on a way of the sheet conveyance path 64, a skew and conveyance timing of the recording member S are corrected by the registration roller 65 and then the registration roller 65 sends the recording member S to a secondary transfer portion T2. The secondary transfer portion T2 is formed of a secondary transfer inner roller 66 and a secondary transfer outer roller 67 facing with each other. The toner image is secondarily transferred from the intermediate transfer belt 8 onto the recording member S in the secondary transfer portion T2 by secondary transfer voltage applied to the secondary transfer inner roller 66.

In connection with the conveyance process of the recording member S to the secondary transfer portion T2 described above, an image forming process of the image delivered in synchronism with the conveyance process to the secondary transfer portion T2 will be described. Firstly, the image forming units PY through PK will be described. Note that the image forming units PY through PK are constructed almost in the same manner except of that the colors of the toners used in the developing units 4Y, 4M, 4C and 4K are different as yellow, magenta, cyan and black. Therefore, the following description will be made by typically exemplifying the yellow image forming unit PY and omitting description of the other image forming units PM, PC and PK.

The image forming unit PY is mainly composed of a photosensitive drum 1Y, a charging unit 2Y, the developing unit 4Y, a photosensitive drum cleaner 6Y and others. A surface of the rotationally driven photosensitive drum 1Y is homogeneously charged by the charging unit 2Y in advance, and an electrostatic latent image is formed by the exposing unit 3 driven based on a signal of image information. Next, the electrostatic latent image formed on the photosensitive drum 1Y is visualized by the toner through a development process of the developing unit 4Y. After that, the toner image formed on the photosensitive drum 1Y is primarily transferred onto the intermediate transfer belt 8 by a predetermined pressurizing force and a primary transfer bias applied from a primary transfer roller 5Y disposed so as to face the image forming unit PY with the intermediate transfer belt 8 between them. The toner left on the photosensitive drum 1Y after the primary transfer is removed by the photosensitive drum cleaner 6Y such as a cleaning blade to be ready for a next image forming process.

The intermediate transfer belt 8 is stretched by a tension roller 10, the secondary transfer inner roller 66 and driven rollers 7*a* and 7*b* and is driven so as to move in a direction of an arrow R2 in FIG. 1. According to the present embodiment, the secondary transfer inner roller 66 functions also as a driving roller driving the intermediate transfer belt 8. The image forming process of each color processed by the image forming units PY through PK described above is performed with a timing of sequentially superimposing on a toner image of a color upstream in the moving direction primarily transferred onto the intermediate transfer belt 8. As a result, a full-color toner image is finally formed on the intermediate transfer belt 8 and is conveyed to the secondary transfer portion T2. Note that the toner left on the intermediate transfer belt 8 after passing through the secondary transfer portion T2 is removed out of the intermediate transfer belt 8 by the transfer cleaning unit 11.

Thus, the timing of the recording member S conveyed by the conveyance process and the full-color toner image formed by the image forming process respectively as described above coincide at the secondary transfer portion T2, and the toner image is secondarily transferred from the intermediate transfer belt 8 onto the recording member S. After that, the recording member S is conveyed to the fixing apparatus 30 to be pressed and heated to melt and fix the toner image onto the recording member S. The recording member S on which the toner image has been fixed is discharged to a sheet discharge tray 601 by a sheet discharge roller 69.

Fixing Apparatus

Figure 2:
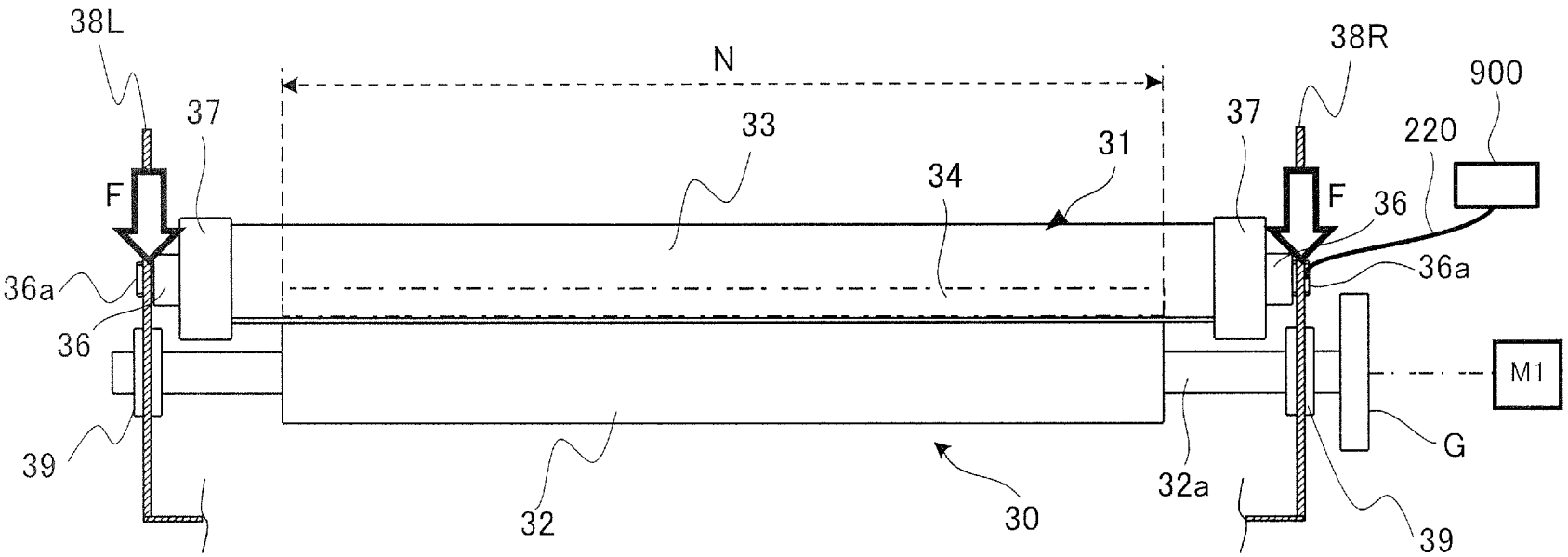
FIG. 2 is a schematic diagram illustrating the fixing apparatus.

Next, the fixing apparatus 30 of the present embodiment will be described with reference to FIGS. 2 through 4. As illustrated in FIG. 2, the fixing apparatus 30 of the present embodiment includes a belt unit 31 and a pressure roller 32 and is arranged to be attachable/detachable to/from the apparatus body of the image forming apparatus 100. The pressure roller 32 serving as a rotary member is provided to be rotatable with respect to the apparatus body such that a rotation shaft 32*a* is born by bearing members 39 provided respectively at side plates 38L and 38R of the apparatus body. The pressure roller 32 is disposed also in parallel with the belt unit 31 and is in contact with the fixing belt 33 of the belt unit 31 to be able to press the fixing belt 33. The pressure roller 32 may be what having an elastic layer such as silicon rubber around the metallic rotation shaft 32*a* serving as a core metal or may be what having a release layer composed of fluororesin such as PTFE, PFA and FEP further around the elastic layer.

The rotation shaft 32*a* of the pressure roller 32 is provided with a drive gear G. A turning force of a motor M1 is transmitted to the drive gear G through a power transmission mechanism not illustrated so that the pressure roller 32 is rotated. Then, because a fixing nip portion N is defined between the fixing belt 33 and the pressure roller 32 as described later, the turning force of the pressure roller 32 is transmitted to the fixing belt 33 by a frictional force generated at the fixing nip portion N. Thus, the fixing belt 33 is rotationally driven by the pressure roller 32 (i.e., a so-called pressure roller driving type). The recording member S is nipped and is conveyed by the pressure roller 32 and the fixing belt 33 rotating as described above. Note that the motor M1 may be provided in the apparatus body of the image forming apparatus 100.

Belt Unit

The belt unit 31 is provided movably to a side of the pressure roller 32 by the side plates 38L and 38R of the apparatus body. The belt unit 31 includes the endless fixing belt 33 formed to be endless such as cylindrical and to be flexible and flanges 37 configured to hold both ends, in a longitudinal direction, of the fixing belt 33. It can also be said that the flanges 37 hold both ends, in a width direction or a rotation axial direction of the pressure roller 32, of the fixing belt 33. The fixing belt 33 is provided removably to the belt unit 31. The fixing belt 33 may be a resin belt having a conductive layer with high thermal conductivity and low heat capacity or a composite layered structure belt having an elastic layer, a release layer or the like around a base layer of or a metal belt for example. Note that the fixing belt 33 of the present specification includes a thin film belt.

In the case of the present embodiment, the flanges 37 are outfitted to the both end portions of the fixing belt 33. When the fixing belt 33 moves in the longitudinal direction, the flanges 37 receive the longitudinal end portions of the fixing belt 33 and regulate the longitudinal move of the fixing belt 33. In other words, in a case where the fixing belt 33 moves in the longitudinal direction while been rotated by the pressure roller 32, one longitudinal end portion of the fixing belt 33 butts against the flange 37 and a further move of the fixing belt is restricted. That is, there is a case where the pressure roller 32 and the fixing belt 33 are disposed so as to be slightly unparalleled due to a mounting error or the like of the pressure roller 32 and the belt unit 31. In such a case, the fixing belt 33 may move while leaning in the longitudinal direction while being rotated by the pressure roller 32. Then, in order to suppress the leaning move of the fixing belt 33 caused by the pressure roller 32, the flanges 37 are outfitted to the fixing belt 33.

According to the present embodiment, a stay 36, more specifically an arm portion 36*a* described later, is urged toward the pressure roller 32 with a predetermined urging force F by an urging mechanism not illustrated such as a spring. Thereby, the fixing belt 33 comes into pressure contact with the pressure roller 32 with a desirable pressure contact force. By bringing the fixing belt 33 into pressure contact with the pressure roller 32, the fixing nip portion N through which the recording member S is passed, while being pressed, to heat and to fix the toner image to the recording member S is defined between the fixing belt 33 and the pressure roller 32. Then, a bundle line, in which the signal lines 220 for supplying power and transmitting/receiving control signals are bundled, is led out of inside of the belt unit 31. A connector 900 is attached at an edge of the bundle line (signal lines 220). This connector 900 is arranged to be connected with a connector not illustrated and provided in the apparatus body of the image forming apparatus 100.

The belt unit 31 will be described in detail by using FIGS. 3 and 4 and with reference to FIG. 2. It is note that the fixing belt 33 is attached to the belt unit 31 by moving in a direction opposite to a direction of an arrow Y illustrated in FIG. 4.

Figure 3:
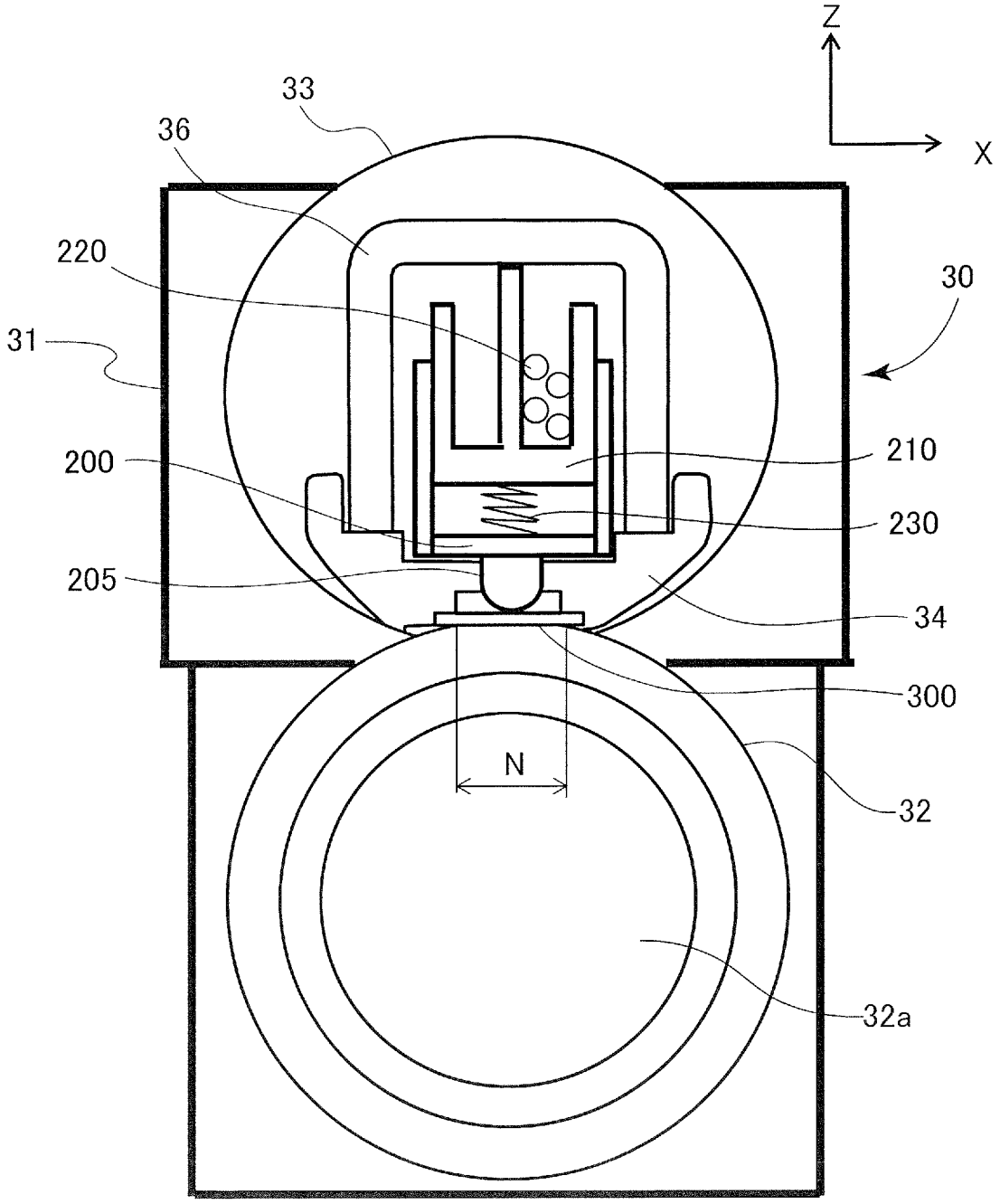
FIG. 3 is a section view illustrating the fixing apparatus.

As illustrated in FIG. 3, the belt unit 31 includes a heater holder 34, a stay 36 and a sensor holder 210 within the fixing belt 33. The stay 36 is a metallic rigid member for example extending in the longitudinal direction along the fixing belt 33 and is formed into a shape having a transverse section of approximately U so as to have an opening on a side of the heater holder 34. The stay 36 and the heater holder 34 are formed to be able to attach with each other by sandwiching the sensor holder 210 to give the heater holder 34 with longitudinal strength and to press the heater holder 34 adequately to an inner peripheral surface of the fixing belt 33. Note that the arms 36*a* are formed on the both end portions of the stay 36 and the flanges 37 are attached to the arms 36*a* as described above (see FIG. 2).

In the present embodiment, the fixing belt 33 is pressed toward the pressure roller 32 from the inside by the heater holder 34 supported by the stay 36 to be able to define the fixing nip portion N more securely. While the heater holder 34 is a heat resistant and high insulating resin-made member to hold the heater 300, the heater holder 34 functions also as a pressure pad for pressing the fixing belt 33 in the present embodiment.

Figure 4:
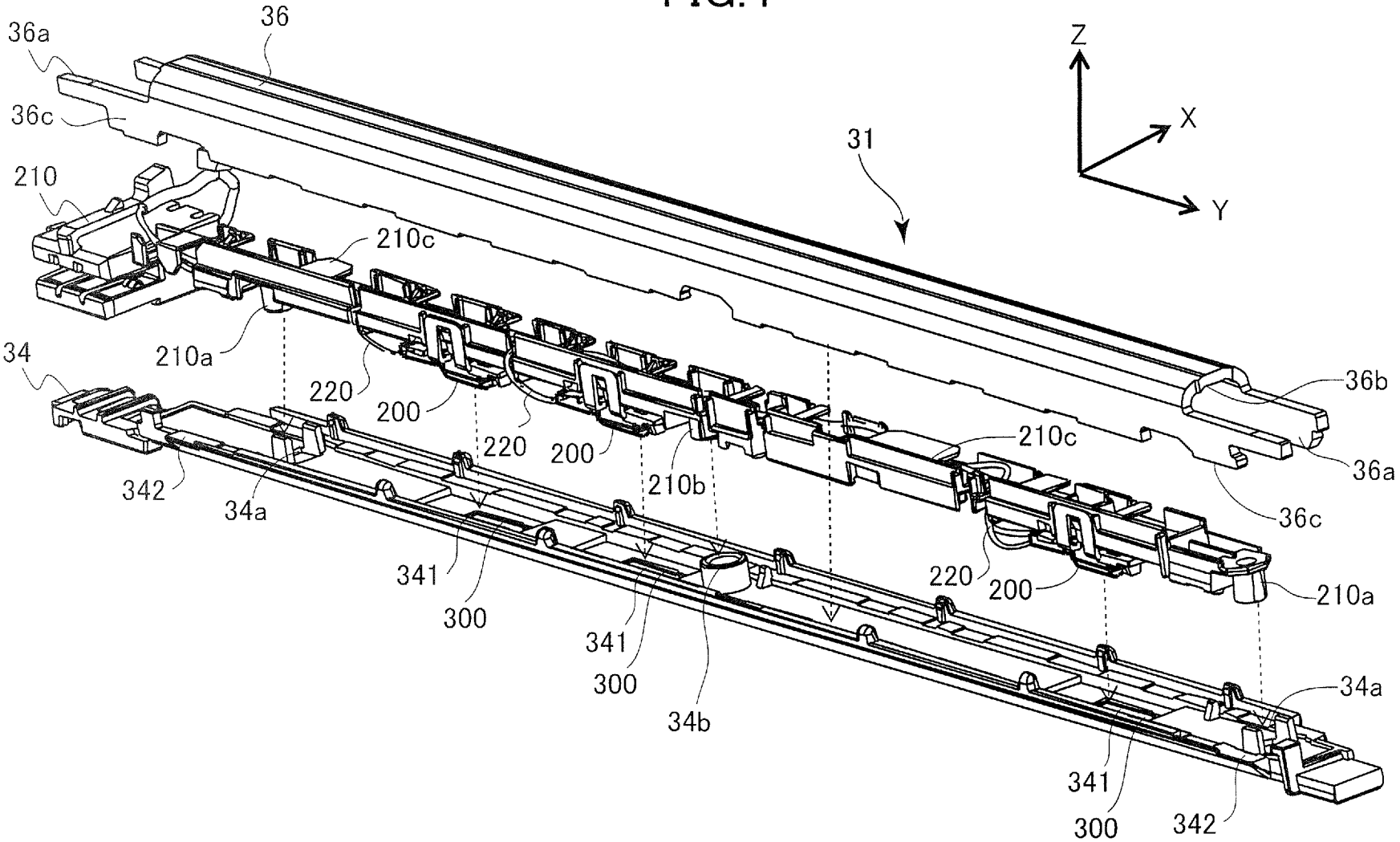
FIG. 4 is an exploded perspective view illustrating a belt unit.

As illustrated in FIG. 4, the heater holder 34 is a molded article extending in the longitudinal direction for example and holds the heater 300 serving as a heating member. The heater holder 34 is provided with a fitting channel configured to fit with and to hold the heater 300 and formed into a shape extending in the longitudinal direction on a side opposite from the stay 36. The heater 300 held by the heater holder 34 is in contact with an inner peripheral surface of the fixing belt 33 to heat the fixing belt 33 (see FIG. 3). The heater 300 is a low heat capacity ceramic heater or the like having a thin ceramic substrate having an electric heating resistor layer. Temperature of the heater rises by supplying power to the electric heating resistor layer.

In order to control the temperature of the fixing belt 33, the present embodiment is provided with a temperature sensor 200 for detecting temperature of the heater 300. A contact type temperature sensor 200 such as a thermistor sensor is adopted in the present embodiment. As illustrated in FIG. 4, the temperature sensor 200 is held by a sensor holder 210 formed of a heat resistant resin for example. The sensor holder 210 serving as a holding member is provided on a side opposite from the heater 300 across the temperature sensor 200 to hold the temperature sensor 200. The temperature sensor 200 is attached to the sensor holder 210 such that a surface, on a side opposite from the thermistor 205 (see FIG. 3), is covered. Then, according to the present embodiment, fitting channels 341 are defined at a plurality of positions, e.g., three positions, in the longitudinal direction of the heater holder 34, i.e., in the rotation axial direction of the pressure roller 32 illustrated in FIG. 3. The fitting channels 341 are opened such that a part of the temperature sensor 200 is exposed out of the heater holder 34 to the side of the heater 300. Note that while the positions and the numbers of the temperature sensors 200 are not limited to what illustrated in FIG. 4, it is preferable to adjust the positions and the numbers so as to be able to uniformly detect the temperature of the fixing belt 33. For instance, it is preferable to dispose the temperature sensors 200 at least at a longitudinal center part and end parts of the fixing belt 33.

Returning to FIG. 3, a sensor urging spring 230 that urges the temperature sensor 200 toward the heater 300 is provided between the sensor holder 210 and the temperature sensor 200. The sensor urging spring 230 serving as an urging member is provided to bring the thermistor 205 serving as a detection unit into contact with the heater 300 with predetermined pressure, e.g., 2 N. In a case where the thermistor 205 is brought in contact with the heater 300 across its whole surface by the sensor urging spring 230, the temperature sensor 200 is able to accurately detect the temperature of the heater 300. Because the temperature sensor 200 is thus held by the sensor holder 210 through the sensor urging spring 230, the temperature sensor 200 is movable with respect to the sensor holder 210.

Power for controlling the temperature of the heater 300 is supplied from a power source not illustrated and provided in the apparatus body of the image forming apparatus 100. Still further, power for operating the temperature sensor 200, more specifically the thermistor 205, is supplied from another power source not illustrated and provided in the apparatus body of the image forming apparatus 100. Then, a detection result, e.g., a voltage signal, of the temperature sensor 200 is transmitted to a control portion not illustrated. The control portion controls the power supplied to the heater 300 to control the temperature of the heater 300 based on the detection result of the temperature sensor 200 such that the temperature of the fixing belt 33 is kept at target temperature, e.g. 180° C. Note that the control portion includes a CPU (Central Processing Unit), a ROM (Read Only Memory), a RAM (Random Access Memory) and others. The control portion may be one provided in the apparatus body of the image forming apparatus 100 to execute a control program such as an image forming job to perform various controls such as an image forming operation.

The temperature sensor 200 is connected with the signal lines 220 for supplying power and for transmitting detection results, and the sensor holder 210 is provided with a guide for leading the bundle line in which the plurality of signal lines are bundled out of the belt unit 31. In a case of the present embodiment, the sensor holder 210 is provided with a through hole 216 for leading the signal line 220 out the belt unit 31 as a part of such guide (see FIGS. 5A and 5B described later).

The stay 36, the sensor holder 210 and the heater holder 34 described above are formed to be assemblable as one unit in a condition in which the temperature sensor 200 is held by the sensor holder 210 and in which the heater 300 is held by the heater holder 34. Then, a method for assembling the stay 36, the sensor holder 210 and the heater holder 34 will be briefly described with reference to FIGS. 3 and 4.

Firstly, as illustrated in FIG. 4, a positioning shaft 210*b* provided at a longitudinal center part of the sensor holder 210 is fitted into a positioning hole 34*b*. Then, rotation stopping shafts 210*a* provided respectively at both longitudinal end portions of the sensor holder 210 are fitted into rotation stopping holes 34*a* provided on the heater holder 34. Thereby, the temperature sensor 200, more specifically the thermistor 205, held by the sensor holder 210 is brought into contact with the heater 300 held by the heater holder 34 by an urging force of the sensor urging spring 230 (see FIG. 3). The three temperature sensors 200 are attached to the sensor holder 210 in advance in a condition in which the respective signal lines 220 are bundled in advance. The bundle line is creeped through the guide formed in the sensor holder 210 and is led out of one end portion of the sensor holder 210.

The stay 36 is attached to the heater holder 34 so as to surround the sensor holder 210. That is, the stay 36 and the heater holder 34 are positioned such that a counter face 36*c* of the stay 36 is in contact with a counter face 342 of the heater holder 34 in a direction of an arrow Z in FIG. 4. Thereby, a space for storing the sensor holder 210 is assured between the stay 36 and the heater holder 34. Still further, the stay 36 and the sensor holder 210 are positioned such that a counter face 36*b* of the stay 36 is in contact with a counter face 210*c* of the sensor holder 210 in the direction of the arrow Z in FIG. 4. Thereby, a position of the sensor holder 210 in the Z direction is determined, and the temperature sensor 200, more specifically the thermistor 205, can be in contact with the heater 300 by the sensor urging spring 230 (see FIG. 3).

Figure 5A:
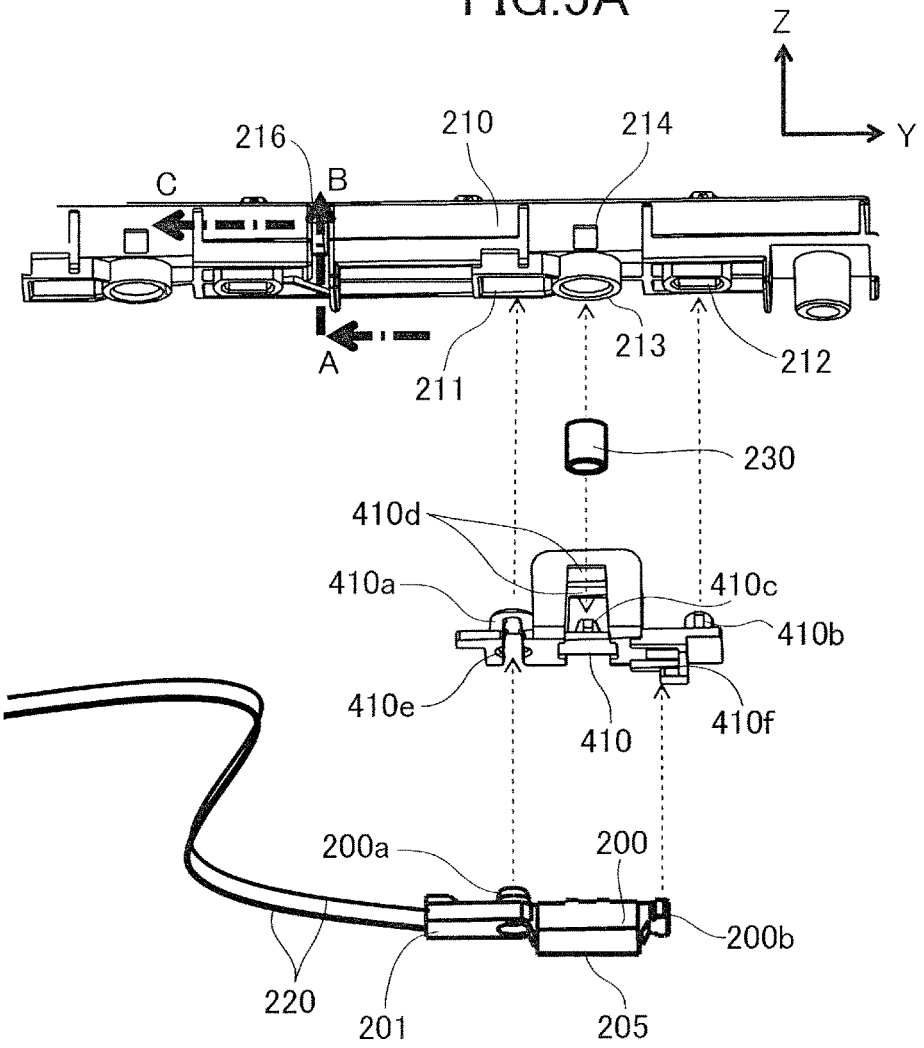
FIG. 5A is a partially enlarged exploded perspective view illustrating a sensor holder configured to hold a temperature sensor.
Figure 5B:
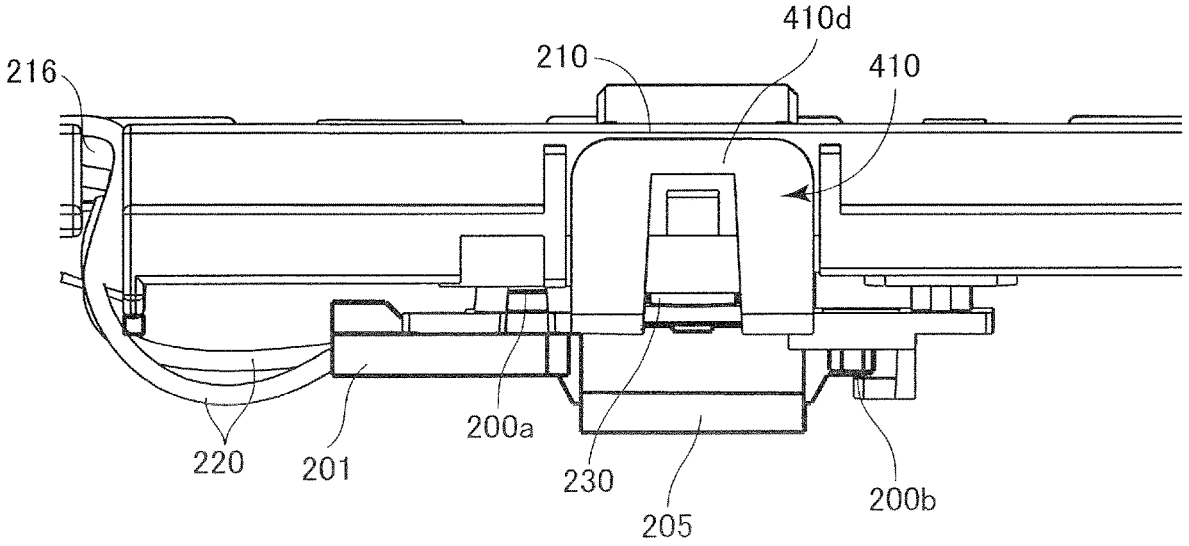
FIG. 5B is a partially enlarged view illustrating a condition of the temperature sensor held by the sensor holder.

Next, a method how to hold the temperature sensor 200 by the sensor holder 210 will be described with reference to FIGS. 5A and 5B. In a case of the present embodiment, the sensor holder 210 includes a removable attachment member 410 to hold the temperature sensor 200. The temperature sensor 200 is idly fitted into the attachment member 410. Specifically, the attachment member 410 is provided with an attachment hole 410*e*, and a positioning boss 200*a* of the temperature sensor 200 is pressed into the attachment hole 410*e*. However, the temperature sensor 200 may rotate with respect to the attachment member 410 as it is. Then, the attachment member 410 is provided with a rotation stopping hole 410*f* separately from the attachment hole 410*e*, and a rotation stopping portion 200*b* of the temperature sensor 200 is fitted into the rotation stopping hole 410*f* in order to suppress the temperature sensor 200 from rotating. Thus, the temperature sensor 200 is provided movably in the attachment member 410.

The attachment member 410 to which the temperature sensor 200 is attached is mounted to the sensor holder 210. As illustrated in FIG. 5A, the attachment member 410 is provided with an elastic engage member 410*d* and the sensor holder 210 is provided with an engaged member 214 so as to project from a side surface to be able to removably attach the attachment member 410 to the sensor holder 210. Still further, the attachment member 410 is provided with positioning bosses 410*a* and 410*b* at distant positions in the longitudinal direction of the sensor holder 210. Meanwhile, the sensor holder 210 is provided with positioning holes 211 and 212 at positions facing the positioning bosses 410*a* and 410*b*. The attachment member 410 is mounted to the sensor holder 210 by engaging the engage member 410*d* with the engaged member 214 and by fitting the positioning bosses 410*a* and 410*b* respectively into the positioning holes 211 and 212.

The attachment member 410 is mounted to the sensor holder 210 in a condition in which the sensor urging spring 230 is disposed between the temperature sensor 200 and the sensor holder 210. A first end of the sensor urging spring 230 is fitted into a positioning groove 213 of the sensor holder 210 and a second end is fixed to a boss 410*c* of the sensor holder 210. Thereby, the temperature sensor 200 idly fitted into the attachment member 410 is urged by the sensor urging spring 230. As described above, the engagement of the engage member 410*d* with the engaged member 214 makes it possible to prevent the attachment member 410 from coming out of the sensor holder 210 by the urging force of the sensor urging spring 230.

In a case of the present embodiment, the signal line 220 of the temperature sensor 200 mounted in the sensor holder 210 is passed through a though hole 216 defined through the sensor holder 210. As indicated by arrows A through C in FIG. 5A, the through hole 216 is defined so as to lead the signal line 220 out of a side of the sensor holder 210 where the temperature sensor 200 is held (called as a front side for convenient) to an opposite side where the temperature sensor 200 is not held (called as a back side for convenient). The through hole 216 is defined at a position distant from an end of the temperature sensor 200 on a side of a connecting portion 201, e.g., a metal terminal, to which the signal line 220 is connected per each temperature sensor 200. It is noted that the signal lines 220 of all temperature sensors 200 led out of the through hole 216 are wired so as to be directed in one direction indicated by the arrow C at the back side of the sensor holder 210.

By the way, the user connects a connector 900 (see FIG. 2) on the side of the belt unit 31 with a connector not illustrated and provided in the apparatus body in mounting the belt unit 31 to the apparatus body of the image forming apparatus 100. At this time, there is a case where the user strongly pulls the signal line 220 together with the connector 900 on the belt unit 31 side toward the connector of the apparatus body as described above. There is also a case where the user strongly pulls the signal line 220 to wire the signal line 220 in the belt unit 31 to dispose the connector 900 of the belt unit 31 at a position where the connector 900 can be readily connected with the connector of the apparatus body in replacing the fixing belt 33. There is also a case where a manufacturer strongly pulls the signal line 220 of the temperature sensor 200 in assembling the belt unit 31. If the user or the manufacturer strongly pulls the signal line 220 in a case of a prior art apparatus, the temperature sensor 200 connected at the edge of the signal line 220 is liable to be inclined with respect to the heater 300.

Figure 8:
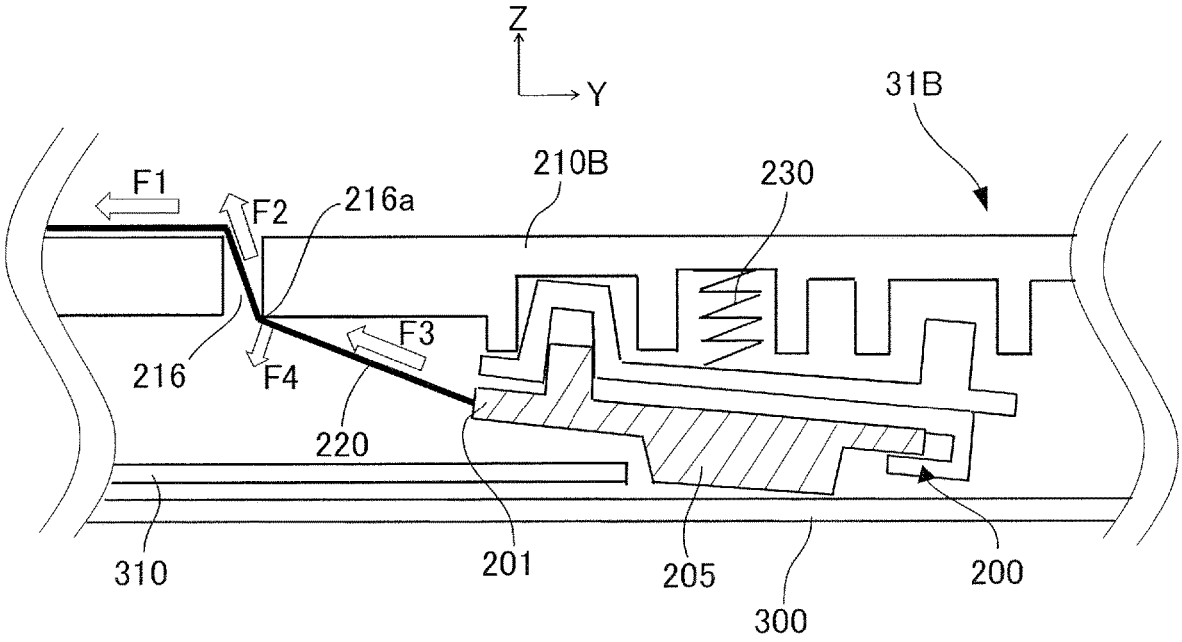
FIG. 8 is a section view illustrating a prior art sensor holder.

FIG. 8 illustrates one example of a prior art belt unit 31B. As illustrated in FIG. 8, if the user pulls the signal line 220 in a direction opposite to the direction of the arrow Y in FIG. 8, forces as indicated by arrows F1 through F4 act on the signal line 220. Specifically, a force indicated by the arrow F1 in FIG. 8 acts on the signal line 220 at the back position of the sensor holder 210B, a force indicated by the arrow F2 in FIG. 8 acts on the signal line 220 passed through the through hole 216 and a force indicated by the arrow F3 in FIG. 8 acts on the signal line 220 at the front position of the sensor holder 210B, respectively.

If degree of a vertical component, in the direction of the arrow Z, of the force acting on the signal line 220 at the front position, i.e., the force F3, becomes greater than the urging force of the sensor urging spring 230, the temperature sensor 200 starts to incline such that the temperature sensor 200 separates away from the heater 300. Then, if the signal line 220 comes into contact with an edge 216*a* on the side of the temperature sensor 200, i.e., on the side of the temperature detecting member, of the through hole 216, the temperature sensor 200 is kept being inclined. If the temperature sensor 200 is held by the sensor holder 210B while being inclined with respect to the heater 300, the thermistor 205 cannot be in contact appropriately with the heater 300, making it difficult to accurately detect the temperature. Then, there is a possibility of frequently causing fixing failures of toner images onto the recording member S. It is also difficult to specify a cause of fixing failures caused by such inclination of the temperature sensor 200, thus increasing a downtime of the image forming apparatus 100 and making it more difficult to execute efficient operations.

In view of the problems described above, according to the present embodiment, an arrangement is made to regulate the move of the signal line 220 such that the temperature sensor 200 is not moved in the direction of separating away from the heater 300 and is not kept while being inclined with respect to the sensor holder 210. The sensor holder 210 of the first embodiment will now be described with reference to FIG. 6.

Figure 6:
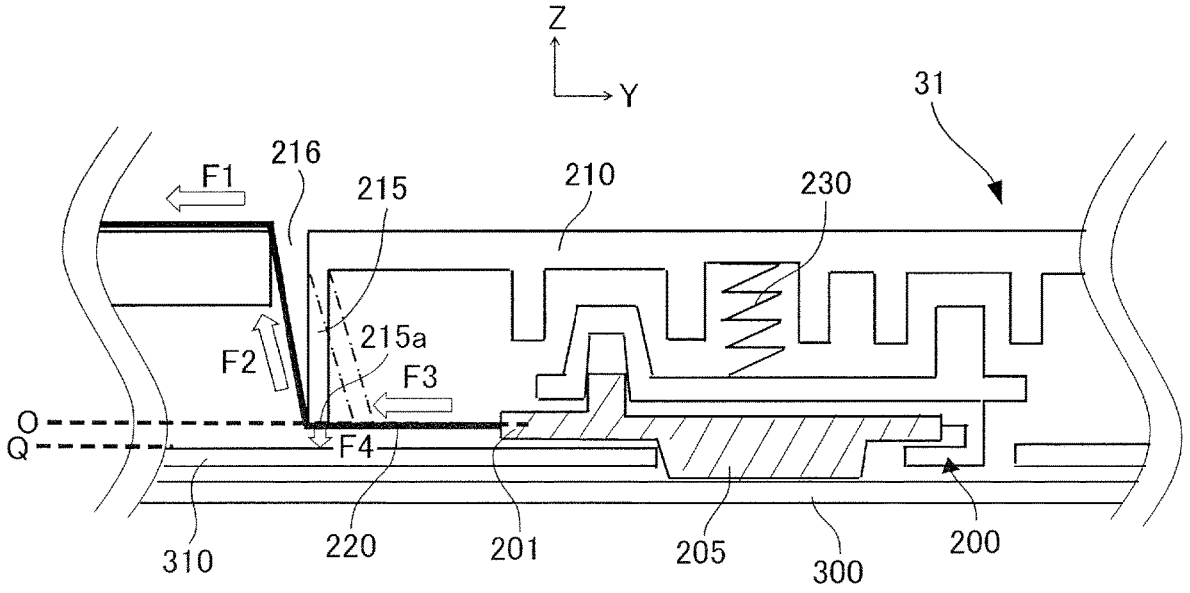
FIG. 6 is a section view illustrating the sensor holder of the first embodiment.

As illustrated in FIG. 6, the sensor holder 210 of the present embodiment is provided with a signal line suppressing rib 215 serving as a contact portion at a position between the through hole 216 and the temperature sensor 200 in the longitudinal direction (the width direction) of the fixing belt 33. The signal line suppressing rib 215 is provided so as to project from an edge, on the side of the temperature sensor 200, of the through hole 216 toward the heater 300 and is formed to come in contact with the signal line 220 at a position on a same level (a dot line O in FIG. 6) with the connecting portion 201 between the signal line 220 and the temperature sensor 200 in the urging direction of the sensor urging spring 230. According to the present embodiment, the levels of the edge position of the signal line suppressing rib 215 and of the position of the connecting portion 201 of the signal line 220 are approximately equal. That is, the signal line suppressing rib 215 comes into contact with the signal line 220 at the position of "0 mm", not leaning toward the heater 300 nor leaning toward the sensor holder 210, based on the position of the connecting portion 201 connected to the signal line 220 in the temperature sensor 200. The signal line suppressing rib 215 thus formed is a rib, serving as a project portion, formed widely and so as to project from the front surface of the sensor holder 210 toward the side of the heater 300, i.e., the side of the heating member, such that the edge portion thereof extends to the abovementioned position indicated by the dot line O in FIG. 6.

In a case where the user pulls the signal line 220 with a strong force more than expected, the signal line suppressing rib 215 regulates the move of the signal line 220 in the Z direction in FIG. 6, i.e., in the direction opposite from the urging direction of the sensor urging spring 230, by pressing down the signal line 220. That is, the signal line 220 is pressed down to the side of the heater 300 by the signal line suppressing rib 215, and the temperature sensor 200 or the connecting portion 201 side in particular is hardly separated significantly from the heater 300, i.e., is hardly inclined (see FIG. 8). This point will be detailed with reference to FIG. 6.

As illustrated in FIG. 6, in a case where the user pulls the signal line 220 in a direction opposite from the Y direction in FIG. 6, forces as indicated by arrows F1 through F4 act on the signal line 220. That is, the force indicated by the arrow F1 in FIG. 6 acts at the position on the back side of the sensor holder 210, the force indicated by the arrow F2 acts at the position where the through hole 216 penetrates and the force indicated by the arrow F3 acts at the position on the front side of the sensor holder 210. Still further, because the sensor holder 210 is provided with the signal line suppressing rib 215 as described above, the force indicated by the arrow F4 acts at the position where the signal line 220 is suppressed by the signal line suppressing rib 215, more specifically by a front edge (a distal end) 215*a* of the signal line suppressing rib 215, to the side of the heater 300.

Because the force indicated by the arrow F4 acting at the front edge 215*a* of the signal line suppressing rib 215 acts as a reaction force of the force indicated by the arrow F2, the move of the signal line 220 in the Z direction is regulated by the force indicated by the arrow F4. Because the force indicated by the arrow F4 increases as the force pulling the signal line 220 increases and acts as a stronger reaction force to the force indicated by the arrow F2, the signal line 220 is suppressed toward the side of the heater 300. Then, by being suppressed by the signal line suppressing rib 215, the signal line 220 in a range between the connecting portion 201 to the front edge 215*a* of the signal line suppressing rib 215 in the longitudinal direction of the sensor holder 210 is positioned at a certain position in the Z direction. Even if the force indicated by the arrow F3 is applied in this condition, the temperature sensor 200 is only pulled in the direction opposite from the Y direction. That is, degree of a vertical component, i.e., the Z direction, of the force F3 acting on the signal line 220 at the front side position of the sensor holder 210 is equal to almost "zero" and does not increase more than the urging force of the sensor urging spring 230. Accordingly, the temperature sensor 200 will not be inclined so as to separate away from the heater 300, and it is possible to keep the condition in which the temperature sensor 200 is held by the sensor holder 210 while not inclined with respect to the heater 300. Thus, because it is possible to keep the condition in which the thermistor 205 is in contact properly with the heater 300, it is also possible to accurately detect the temperature of the heater 300 by the temperature sensor 200.

As described above, according to the present embodiment, the sensor holder 210 is provided with the signal line suppressing rib 215 formed at the position between the through hole 216 and the temperature sensor 200 in the longitudinal direction (the width direction) of the fixing belt 33. Then, the signal line suppressing rib 215 is formed so as to come into contact with the signal line 220 at the same level (see the dot line O in FIG. 6) with the connecting portion 201 of the signal line 220 and the temperature sensor 200 in the urging direction of the sensor urging spring 230. The signal line suppressing rib 215 suppresses the signal line 220 to the side of the heater 300 so as to regulate the move of the signal line 220 in the Z direction by suppressing the signal line 220 in a case where the signal line 220 is pulled by the user with a strong force more than expected. Thereby, the temperature sensor 200 is not inclined so as to separate away from the heater 300, and it is possible to keep the condition in which the temperature sensor 200 is held by the sensor holder 210 not inclined with respect to the heater 300. Thus, even if the signal line 220 connected with the temperature sensor 200 is pulled, it is possible to keep the condition in which the thermistor 205 is in contact properly with the heater 300 with the easy structure, and to detect the temperature of the heater 300 accurately by the temperature sensor 200.

Second Embodiment

A sensor holder 210A of a second embodiment will be described below with reference to FIG. 7. Note that because component parts other than the sensor holder 210A of the belt unit 31A may be the same with those of the first embodiment (see FIG. 6) described above, the same component parts will be described briefly by denoting the same reference signs or will be omitted here.

As compared to the sensor holder 210 of the first embodiment described above, the sensor holder 210A of the second embodiment is different in that a position where a signal line suppressing rib 215A is formed. The sensor holder 210A is provided with the signal line suppressing rib 215A located on a side closer to the temperature sensor 200, in a vicinity of the connecting portion 201, than an edge 216*a*, on the side of the temperature sensor 200, of the through hole 216 between the through hole 216 and the temperature sensor 200 in the longitudinal direction of the sensor holder 210A. For instance, the signal line suppressing rib 215A is formed in the sensor holder 210A such that the signal line suppressing rib 215A comes into contact with the signal line 220 at a position distant from the end of the signal line at the connecting portion 201 of the pulled signal line 220 and the temperature sensor 200 by about "1 mm". Note that the signal line suppressing rib 215A is formed to come into contact with the signal line 220 at the same level, indicated by the dot line O in FIG. 7, with the end of the signal line on the side of the sensor holder 210A at the connecting portion 201 connected to the temperature sensor 200 in the signal line 220.

In a case where the signal line 220 is pulled by the user with a strong force more than expected, even the signal line suppressing rib 215A formed as described above can regulate a move in the Z direction of the signal line 220 by suppressing the signal line 220. That is, the signal line 220 is suppressed by the signal line suppressing rib 215A to the side of the heater 300, and the temperature sensor 200 or the connecting portion in particular is hardly separated significantly away from the heater 300, i.e., is hardly inclined (see FIG. 8). This point will be detailed with reference to FIG. 7.

Figure 7:
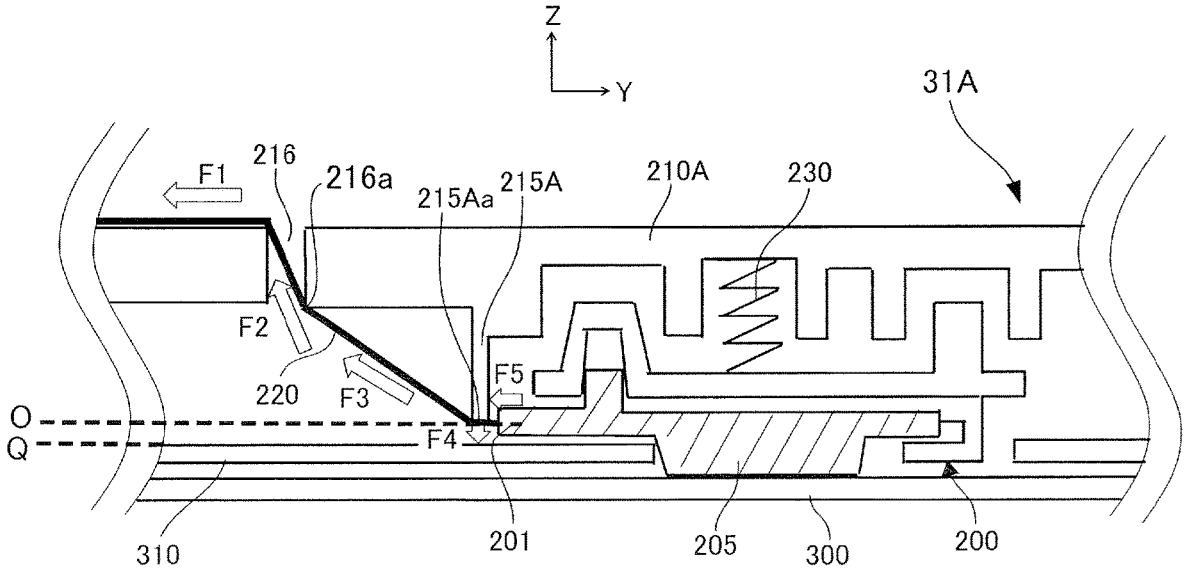
FIG. 7 is a section view illustrating a sensor holder of a second embodiment.

As illustrated in FIG. 7, in a case where the user pulls the signal line 220 in the direction opposite from the Y direction in FIG. 7, forces as indicated by arrows F1 through F4 in FIG. 7 act on the signal line 220. Specifically, the force indicated by the arrow F1 in FIG. 7 acts at the position on the back side of the sensor holder 210A, the force indicated by the arrow F2 acts at the position where the through hole 216 penetrates and the force indicated by the arrow F3 acts at the position on the front side of the sensor holder 210A, respectively. Still further, according to the present embodiment, the force indicated by the arrow F4 acts at the position where the signal line 220 is suppressed by the signal line suppressing rib 215A to the side of the heater 300, i.e., at a front edge 215Aa of the signal line suppressing rib 215A.

Because the force indicated by the arrow F4 acting on the front edge 215Aa of the signal line suppressing rib 215A acts as a reaction force of the force indicated by the arrow F2, the move of the signal line 220 in the Z direction is regulated by the force indicated by the arrow F4. Thereby, because the signal line 220 is suppressed to the side of the heater 300, the signal line 220 is positioned at a certain position in the Z direction in a range between the connecting portion 201 to the front edge 215Aa of the signal line suppressing rib 215A in the longitudinal direction of the sensor holder 210A. Even if the force indicated by the arrow F3 is applied in this condition, the temperature sensor 200 is only pulled by a force indicated by an arrow F5 in FIG. 7 in the direction opposite from the Y direction. That is, degree of a vertical component, i.e., in the Z direction, of the force F3 acting on the signal line 220 equals almost "zero". Accordingly, the temperature sensor 200 will not be inclined so as to separate away from the heater 300. Because it is thus possible to keep the condition in which the thermistor 205 is in contact properly with the heater 300, it is also possible accurately detect the temperature of the heater 300 by the temperature sensor 200.

Other Embodiments

It is noted that while the signal line suppressing rib 215 (215A) described above is formed so as to come into contact with the signal line 220 at the same level with the connecting portion 201 between the signal line 220 and the temperature sensor 200 in the urging direction of the sensor urging spring 230, the present disclosure is not limited such arrangement. The signal line suppressing rib 215 (215A) may be formed such a front edge portion thereof comes into contact with the signal line 220 at a position closer to the side of the heater 300 than the connecting portion 201 of the signal line 220 and the temperature sensor 200. That is, the signal line suppressing rib 215 (215A) may be formed so as to come into contact with the signal line 220 closely to the heater 300 in a range of more than 0 mm and less than 3 mm for example from the position of the connecting portion 201 between the signal line 220 and the temperature sensor 200. The temperature sensor 200 is hardly inclined if the edge of the signal line suppressing rib 215 (215A) is formed at a position closer to the heater 300. Note that it is needless to say that the front edge of the signal line suppressing rib 215 (215A) is formed closely to the heater 300 by leaving a gap between a heater holder 310 of a degree not hampering the signal line 220 passed therethrough (see dot lines Q in FIGS. 6 and 7).

Still further, as indicated by a dot chain line in FIG. 6, the signal line suppressing rib 215 (215A) may be formed so as to project toward the heater 300 to be inclined such that the closer the edge side thereof is to the heater 300, the closer to the connecting portion 201 is. It is preferable to arrange as described above because a force of pulling the signal line 220 in wiring the signal line 220 can be small in addition to the effect of making the temperature sensor 200 to be hardly inclined. In particular, this arrangement is effective in forming the edge of the signal line suppressing rib 215 (215A) described above closely to the heater 300.

It is noted that while the temperature sensor 200 is set to be able to directly detect the temperature of the heater 300 in the embodiments described above, the present disclosure is not limited to such arrangement and may be arranged so as to detect temperature of the heater holder 310 to which the temperature of the heater 300 is transmitted.

Note that the heater 300 is not limited to a ceramic heater and may be a halogen heater, an infrared lamp or the like for example. Still further, the embodiments described above are applicable not only to the configuration of heating the fixing belt 33 but also to a configuration in which a belt-like pressure belt is used instead of the pressure roller 32 and of heating the pressure belt by the heater 300.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-229381, filed on Dec. 6, 2018, which is hereby incorporated by reference herein in its entirety.

What is claimed is:

1. A fixing apparatus comprising:

an endless belt;

a heating member configured to heat the belt;

a temperature detecting member comprising a detection unit being in contact with the heating member and configured to detect temperature of the heating member, and a signal line connected to the detection unit;

a holding member provided on a side opposite to the heating member across the temperature detecting member and configured to hold the temperature detecting member; and an urging member provided between the holding member and the temperature detecting member and configured to urge the temperature detecting member toward the heating member, wherein the holding member comprises a through hole for leading out the signal line and a contact portion being in contact with the signal line at a position located, in a width direction of the belt, between the through hole and the temperature detecting member and located, in an urging direction of the urging member, at a same position with a connecting portion between the signal line and the temperature detecting member or at a position closer to the heating member than the connecting portion.

2. The fixing apparatus according to claim 1, wherein the contact portion is a projecting portion projecting toward the heating member from an edge, on a side of the temperature detecting member, of the through hole.

3. The fixing apparatus according to claim 1, wherein the contact portion is a projecting portion projecting toward the heating member at a position between the through hole and the connecting portion in the width direction.

4. The fixing apparatus according to claim 1, wherein the contact portion is in contact with the signal line within a range more than 0 mm and less than 3 mm from the connecting portion in the urging direction.

5. The fixing apparatus according to claim 1, wherein the contact portion is a projecting portion projecting toward the heating member and is inclined such that the closer the projecting portion is to the heating member, the closer it is to the connecting portion.

6. The fixing apparatus according to claim 1 further comprising:

a rotary member defining a fixing nip portion in which the rotary member is in contact with the belt and nips and conveys a recording member, wherein the belt is a fixing belt that heats the recording member on which a toner image has been formed to fix the toner image onto the recording member when the recording member passes through the fixing nip portion.

* * * * *